US005577964A

United States Patent [19]

Chen

[11] Patent Number: 5,577,964

[45] Date of Patent: Nov. 26, 1996

[54] GOLF BALL TEE DEVICE

[76] Inventor: Ping Chen, No. 29, Nan-Mei St., Nan-Tun Dist., Taichung City, Taiwan

[21] Appl. No.: 571,162

[22] Filed: Dec. 12, 1995

[51] Int. Cl.[6] ..... A63B 69/36

[52] U.S. Cl. ..... 473/145; 473/278

[58] Field of Search ..... 473/139, 140, 473/141, 145, 148; 273/184 B, 185 D

[56] References Cited

U.S. PATENT DOCUMENTS 1,419,636 6/1922 MacDonald ..... 473/145

3,601,398 8/1971 Brochman ..... 473/145 X

*Primary Examiner*—George J. Marlo

*Attorney, Agent, or Firm*—Ladas & Parry

[57] ABSTRACT

A golf ball tee device includes a base unit, an inverted L-shaped support rod having a vertical lower end portion fixed on the base unit and a horizontal upper end portion, and a rotatable device mounted on the upper end portion of the support rod. The rotatable device includes a ball body secured on the upper end portion of the support rod, a casing which encloses rotatably the ball body, and a ball unit which includes a golf ball and a connecting rod that interconnects securely the ball body and the golf ball in such a manner that the golf ball is located at a level above the base unit in a spaced-apart relationship. When the golf ball is struck, the casing and the ball unit rotate about the ball body.

3 Claims, 8 Drawing Sheets

GOLF BALL TEE DEVICE

This application originates from Taiwan patent application No. 83213718 filed Sep. 22, 1994. Said document is incorporated herein by reference.

BACKGROUND OF THE INVENTION

1. Field of the Invention

The invention relates to a golf ball tee device, more particularly to a golf ball tee device by the use of which a user can practise teeing off a golf ball.

2. Description of the Related Art

Referring to FIGS. 1 and 2, a conventional golf ball tee device available for use at home, at the office or at a driving range is shown to include a base unit 1, an inverted L-shaped support rod 4 having a vertical lower end portion 4*a* fixed on the base unit 1 and a horizontal upper end portion 4*b*, and a rotatable device 5 mounted rotatably on the upper end portion 4*b* of the support rod 4. As illustrated, the rotatable device 5 includes a barrel portion 5*a* with an opening 5*a*' formed through a wall body thereof, a right cap 5*b* and a left cap 5*e* which are respectively fixed on two opposed end sections of the barrel portion 5*a*. The right cap 5*b* is constructed as a bearing unit. A spring-loaded push member 5*d* is disposed within the barrel portion 5*a* and sleeved movably on a constricted section 4*b*" of the upper end portion 4*b*. The constricted section 4*b*" passes through the central hole of the right cap 5*b*. The push member 5*b* biases a ball unit 6 toward the left cap 5*e*. The ball unit 6 includes a ball body 6*a* clamped between the push member 5*a* and the left cap 5*e*, and a suspension rope 6*b* which interconnects the ball body 6*a* and a golf ball 6*c* so as to locate the golf ball 6*c* at a level above the base unit 1 in a spaced-apart relationship.

Some drawbacks of the aforesaid golf ball tee device are as follows:

(1) Numerous components are employed to form the tee device, thus resulting in a relatively long assembly time and in a relatively high labor cost.

(2) In the event that the golf club head misses the golf ball during a striking action of the user and accidentally impacts the base unit 1 instead, damage may be caused to the golf club head.

SUMMARY OF THE INVENTION

The object of this invention is to provide a golf ball tee device which is simple in structure so as to reduce the assembly time thereof and which does not cause damage to the golf club head in the event of a miss by the user.

Accordingly, the golf ball tee device of this invention includes a base unit, an inverted L-shaped support rod which has a vertical lower end portion fixed on the base unit and a horizontal upper end portion, and a rotatable device mounted on the upper end portion of the support rod. The rotatable device includes a ball body secured on the upper end portion of the support rod, a casing enclosing rotatably the ball body, and a ball unit which includes a golf ball and a connecting rod which interconnects securely the casing and the golf ball in such a manner that the golf ball is located at a level above the base unit in a spaced-apart relationship. When the golf ball is struck, the casing and the ball unit rotate about the ball body.

In the preferred embodiment, the casing includes two hollow casing halves which confine the ball body therein and which have two notches respectively. The notches of the casing halves cooperatively form a hole in the casing for extension of the upper end portion of the support rod therethrough. The base unit includes a rectangular support plate with a recess formed in an upper surface thereof, a plurality of spaced springs confined in the recess, and a cover sheet attached to the support plate and disposed on the spring units in such a manner that the cover sheet is biased to move upward. Thus, in the event that a golf club head hits the cover sheet instead of the golf ball during a striking action by the user, the cover sheet retracts resiliently into the recess so as to prevent damage to the golf club head.

BRIEF DESCRIPTION OF THE DRAWINGS

Other features and advantages of this invention will become more apparent in the following detailed description of the preferred embodiments with reference to the accompanying drawings, in which.

DETAILED DESCRIPTION OF THE PREFERRED EMBODIMENTS

Figure 1:
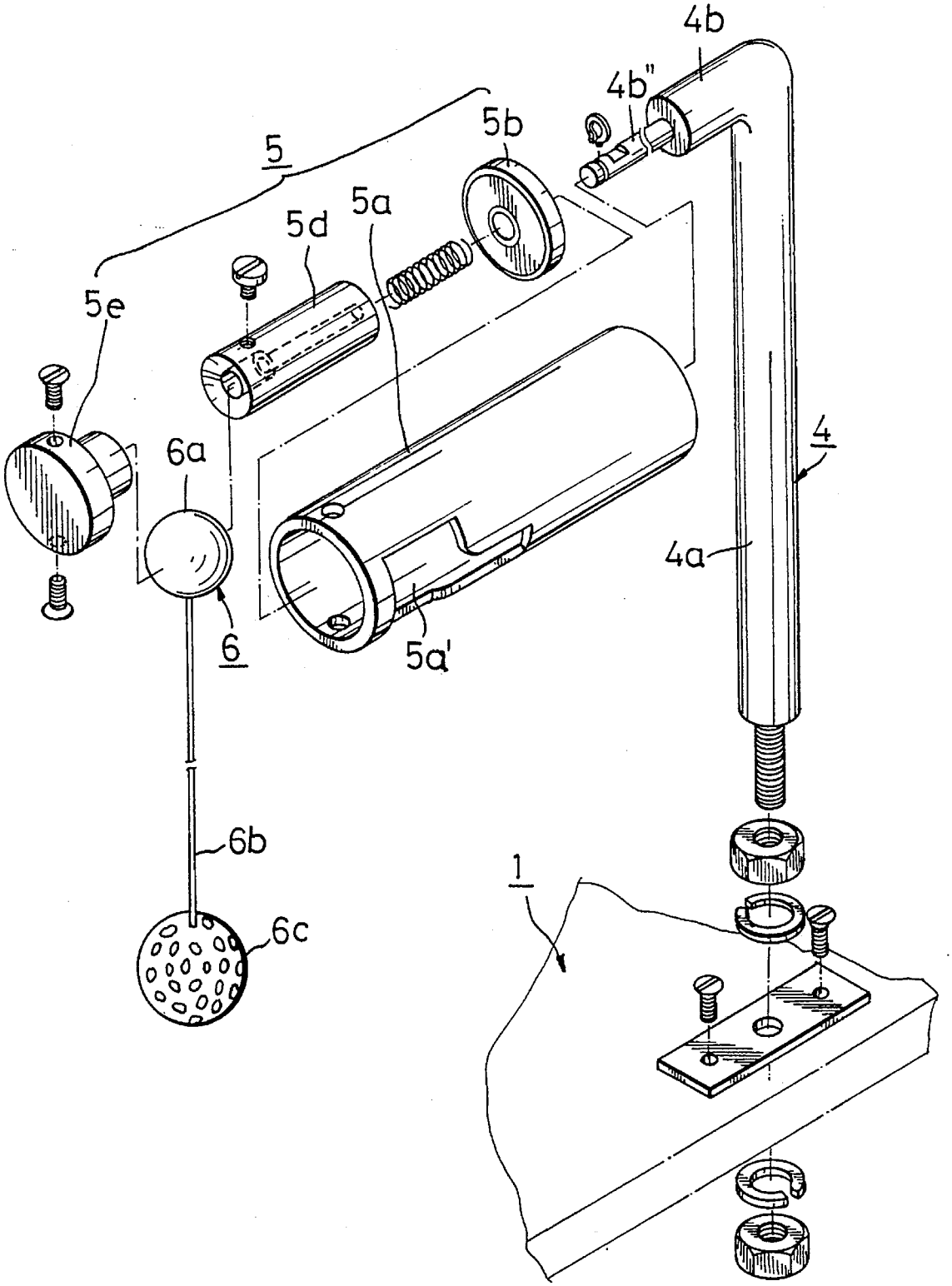
FIG.1 PRIOR ART
FIG. 1 is an exploded view of a conventional golf ball tee device.
Figure 2:
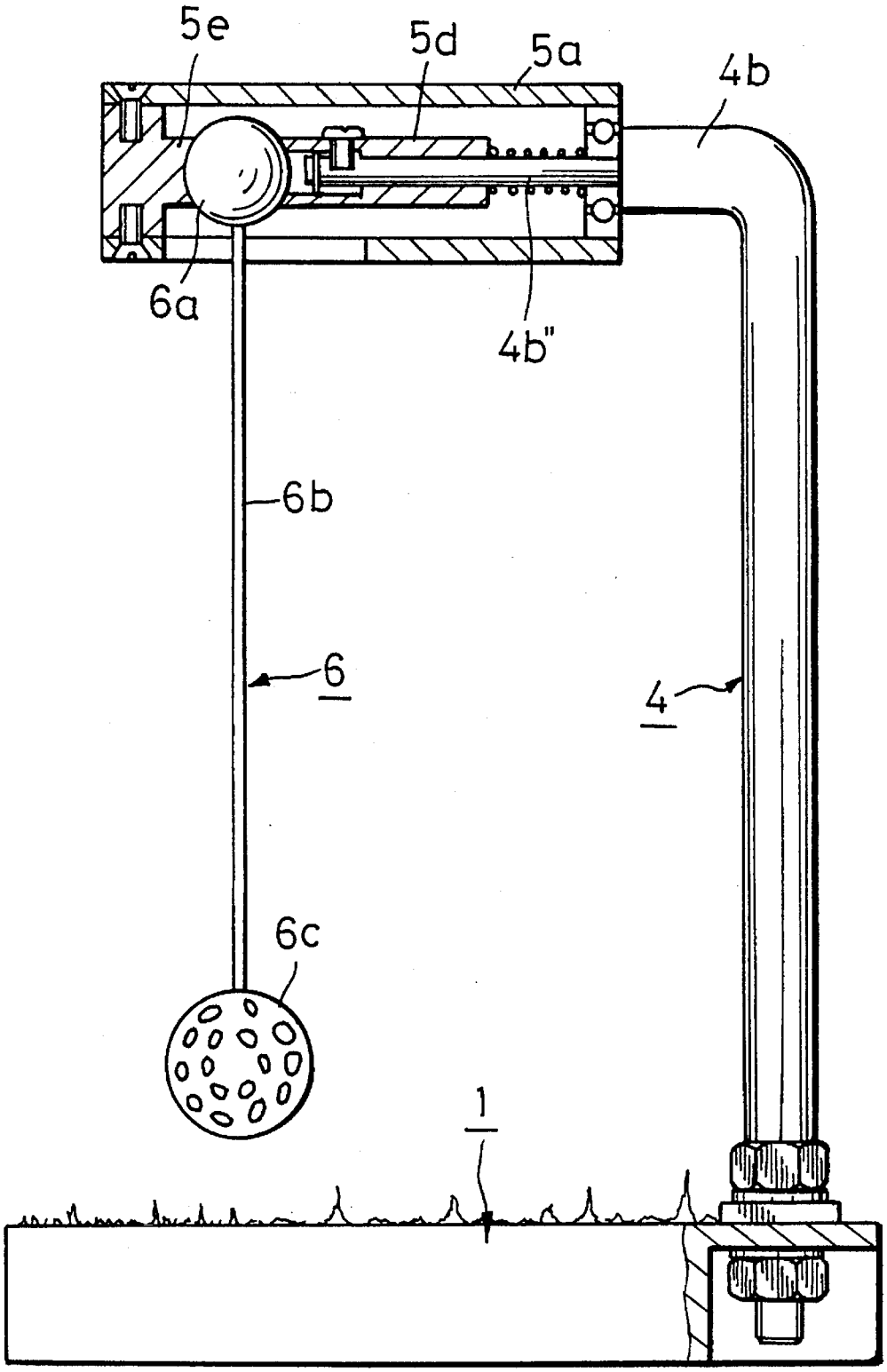
FIG.2 PRIOR ART
FIG. 2 is a schematic view illustrating the conventional golf ball tee device shown in FIG. 1.

Before this invention is described in greater detail, it should be noted that same reference numerals have been used to denote like elements throughout the disclosure.

Figure 3:
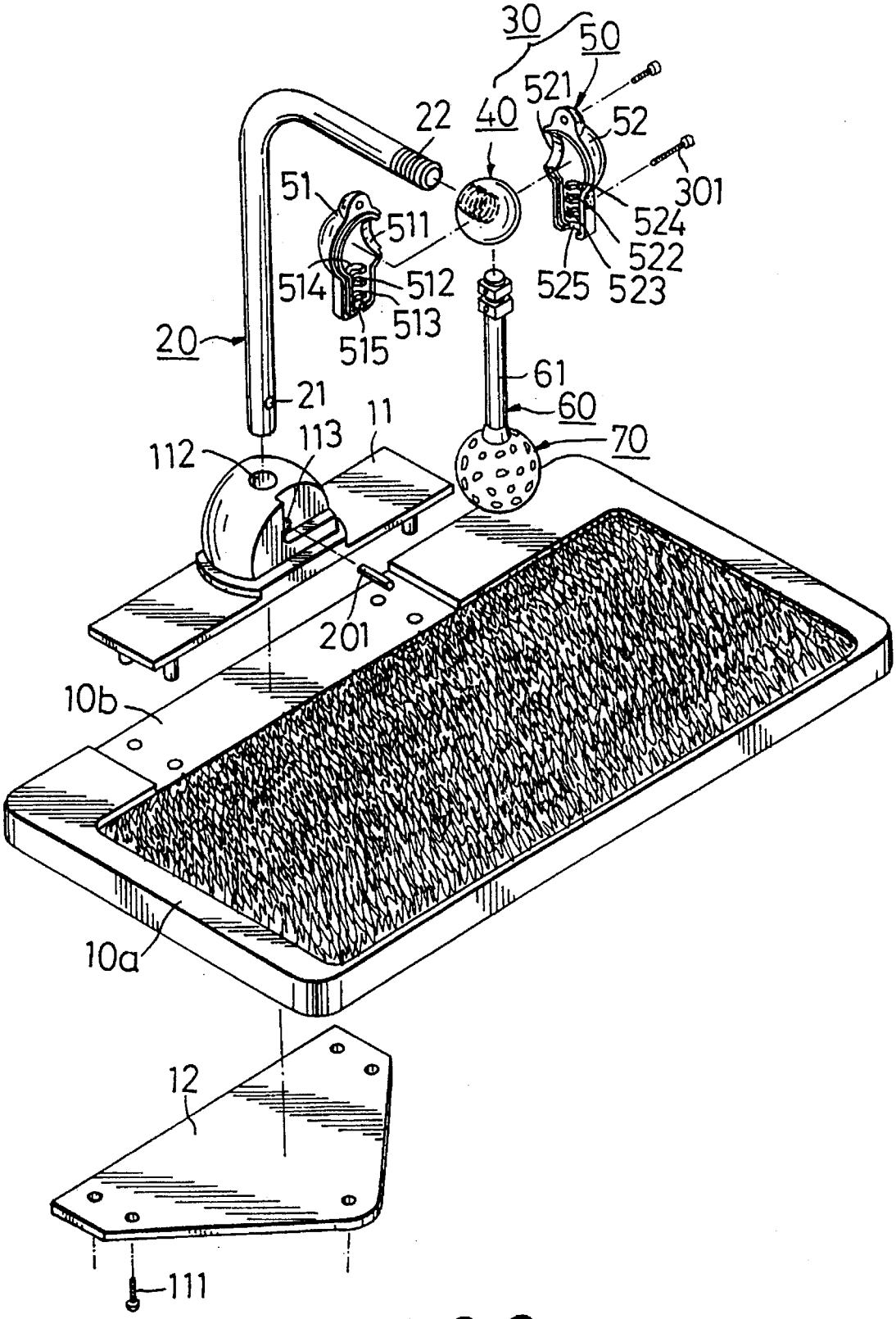
FIG. 3 is a partially exploded view of a first preferred embodiment of a golf ball tee device of this invention.
Figure 4:
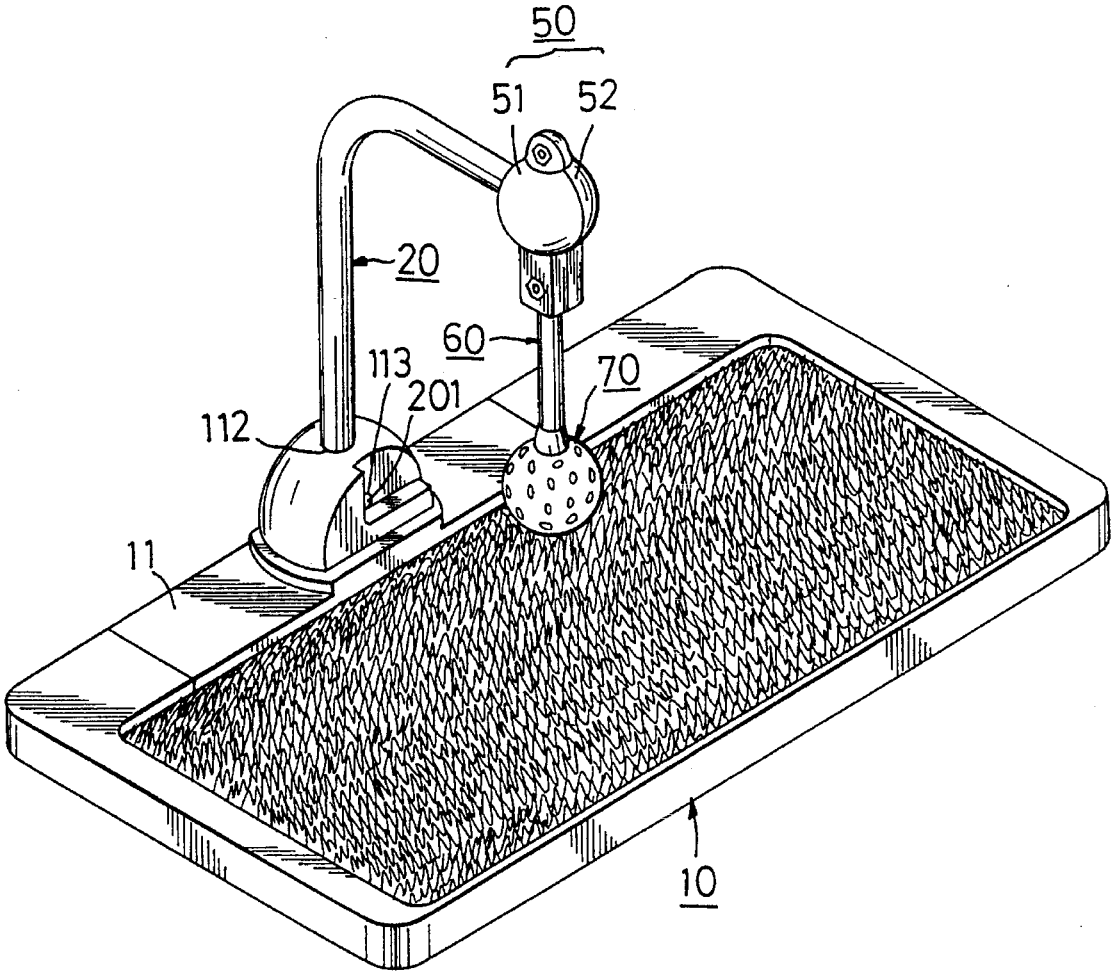
FIG. 4 is a perspective view of the first preferred embodiment of this invention.

Referring to FIGS. 3 and 4, the first preferred embodiment of a golf ball tee device according to this invention includes a base unit 10, an inverted L-shaped support rod 20, and a rotatable device 30.

As illustrated, the base unit 10 includes a rectangular support plate 10*a*, a support seat 11 placed in the recess 10*b* formed in the upper surface of the main support 10*a*, a reinforcing sheet 12 attached to the lower surface of the support plate 10*a*, and a plurality of locking screws 111 which extend through the sheet 12 and the support plate 10*a* and which are threaded to the seat 11 so as to fix the seat 11 on the support plate 10*a*.

The rod 20 has a vertical lower end portion inserted into the vertical hole 112 of the seat 11, and an externally threaded horizontal upper end portion 22. A fastening pin 201 extends through the horizontal hole 113 of the seat 11 and into the radial hole 21 of the lower end portion of the rod 20 so as to mount fixedly the rod 20 on the seat 11. The rotatable device 30 includes a ball body 40 threaded on the upper end portion 22 of the support rod 20, a casing 50 which encloses rotatably the ball body 40, and a ball unit 60.

Figure 5:
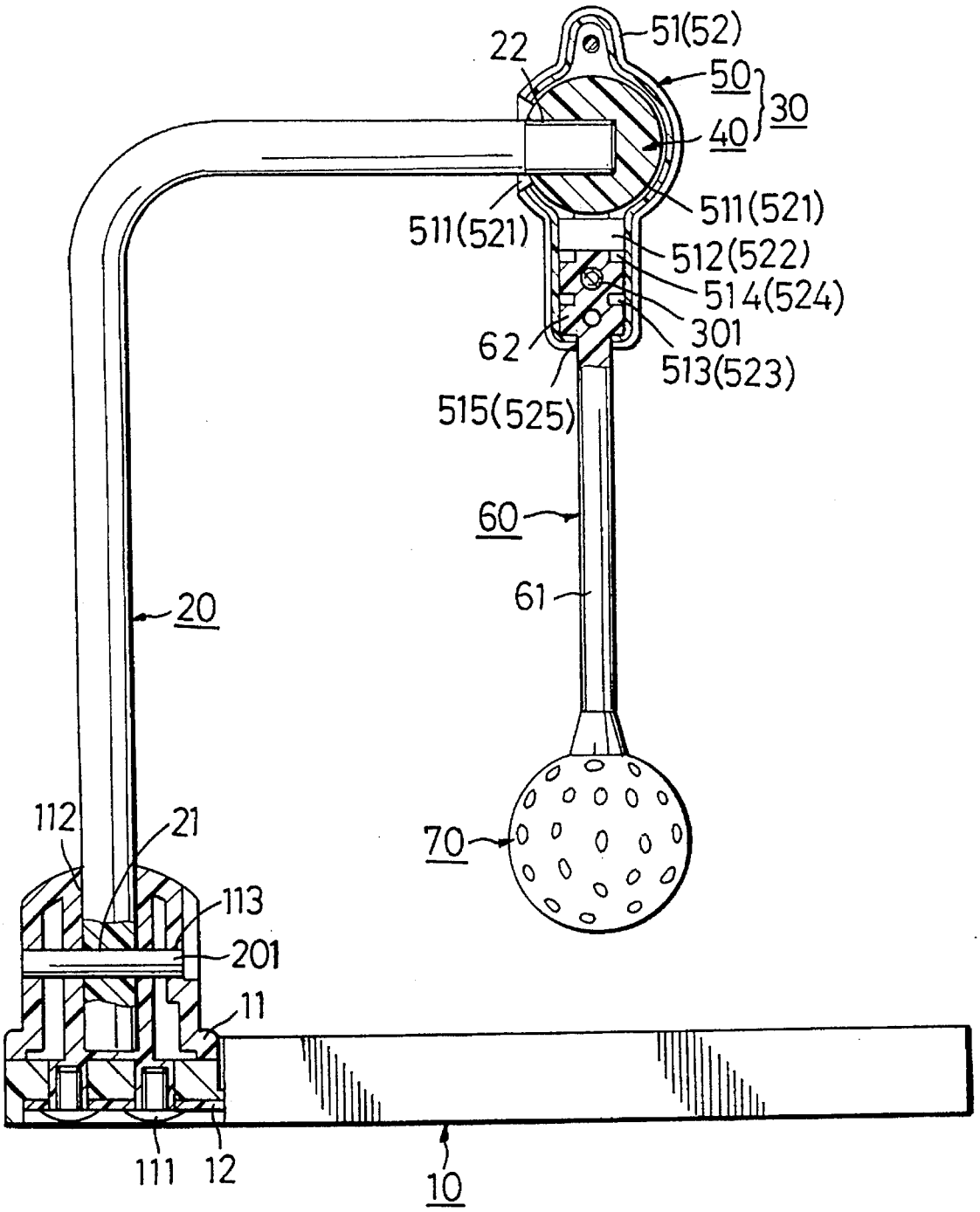
FIG. 5 is a partially sectional view of the first preferred embodiment of this invention.

The casing 50 includes two hollow casing halves 51, 52 which confine the ball body 40 therebetween and which have two notches 511, 521 respectively, and two sets of rib units 512, 513, 522, 523 respectively formed on the inner surfaces of the casing halves 51, 52. Two locking bolts 301 respectively extend through the upper and lower portions of the casing halves 51, 52 so as to join the casing halves 51, 52 together, wherein the notches 511, 521 cooperatively form a hole in the casing 50 for extension of the upper end portion 22 of the support rod 20 therethrough. The ball unit 60 further includes a golf ball 70 and a connecting rod 61 which has an upper portion extending through the openings 515, 525 formed through the lower portion of the casing 50 in such a manner that the engaging tongue units 62 (see FIG. 5) of the connecting rod 61 are confined within the spaces which are defined between the rib units 512, 513, 522, 523 of the casing 50. Under this condition, the golf ball 70 is located at a level above the base unit 10 in a spaced-apart relationship.

Figure 6:
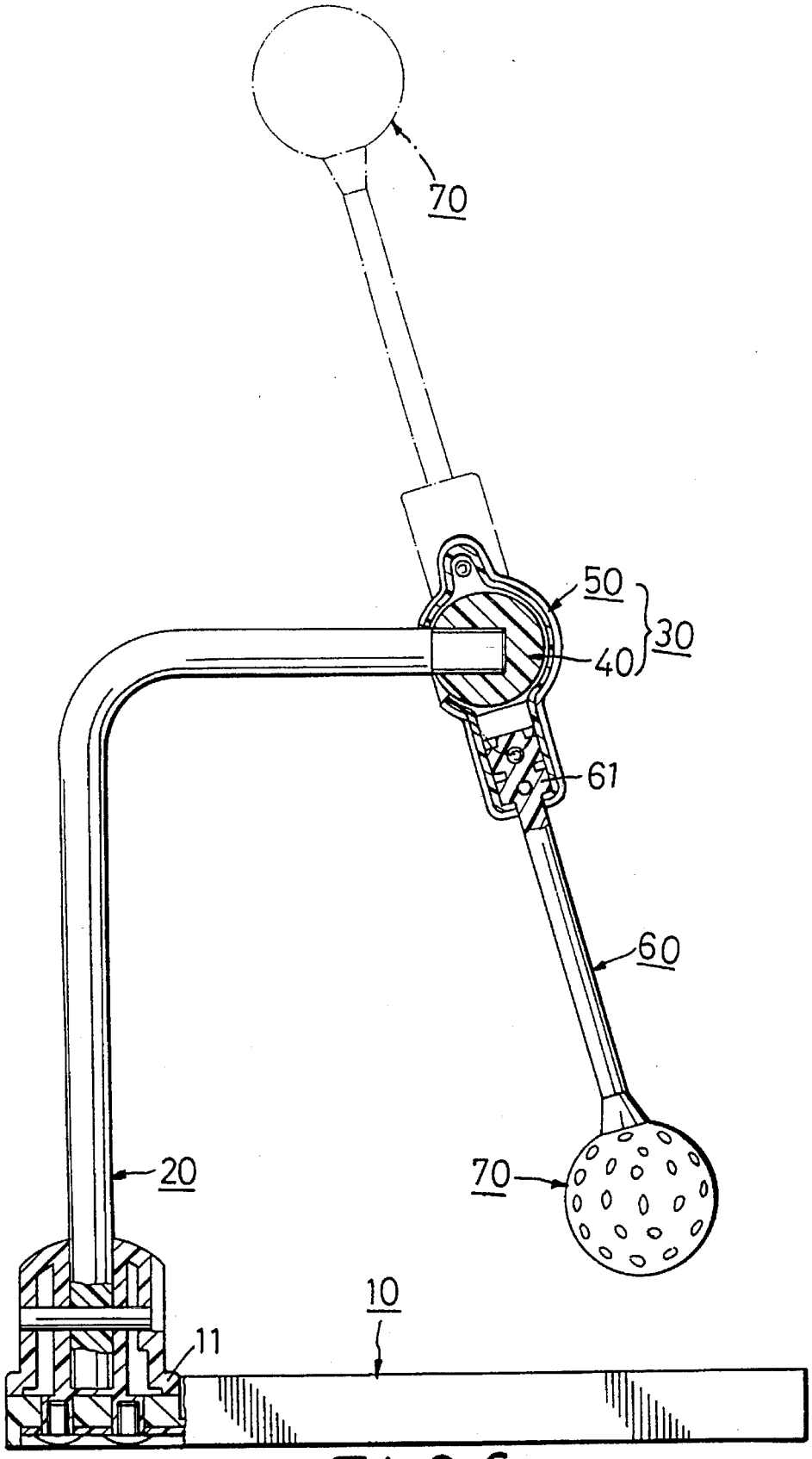
FIG. 6 illustrates how the first preferred embodiment of this invention rotates in one direction when struck.
Figure 7:
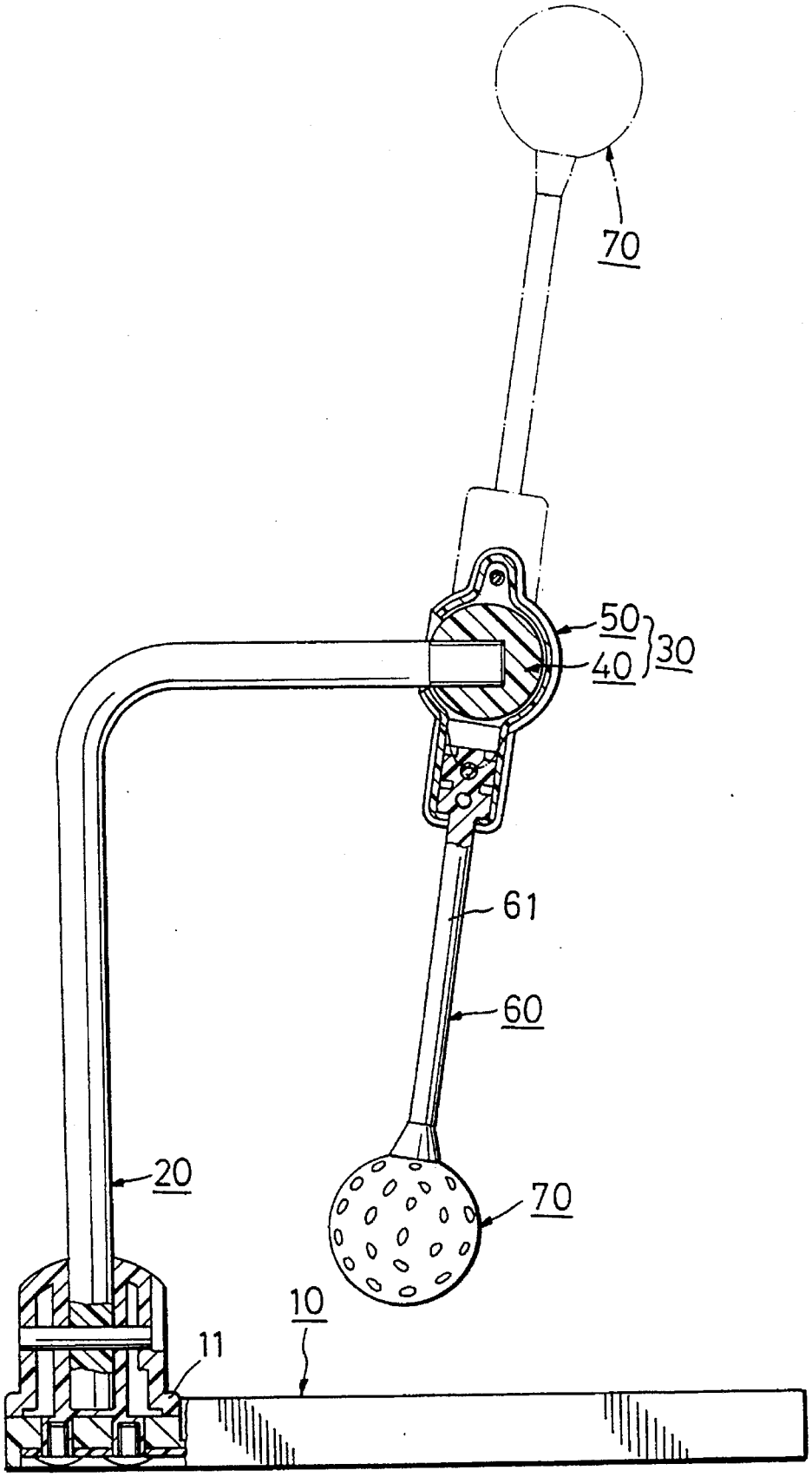
FIG. 7 illustrates how the first preferred embodiment of this invention rotates in another direction when struck.

Referring to FIGS. 6 and 7, when the golf ball 70 is struck, the casing 50 and the ball unit 60 rotate about the ball body 40. As illustrated, in the event that the rotation of the golf ball 70 deviates from the direction desired, the player can correct his or her teeing action.

Figure 8:
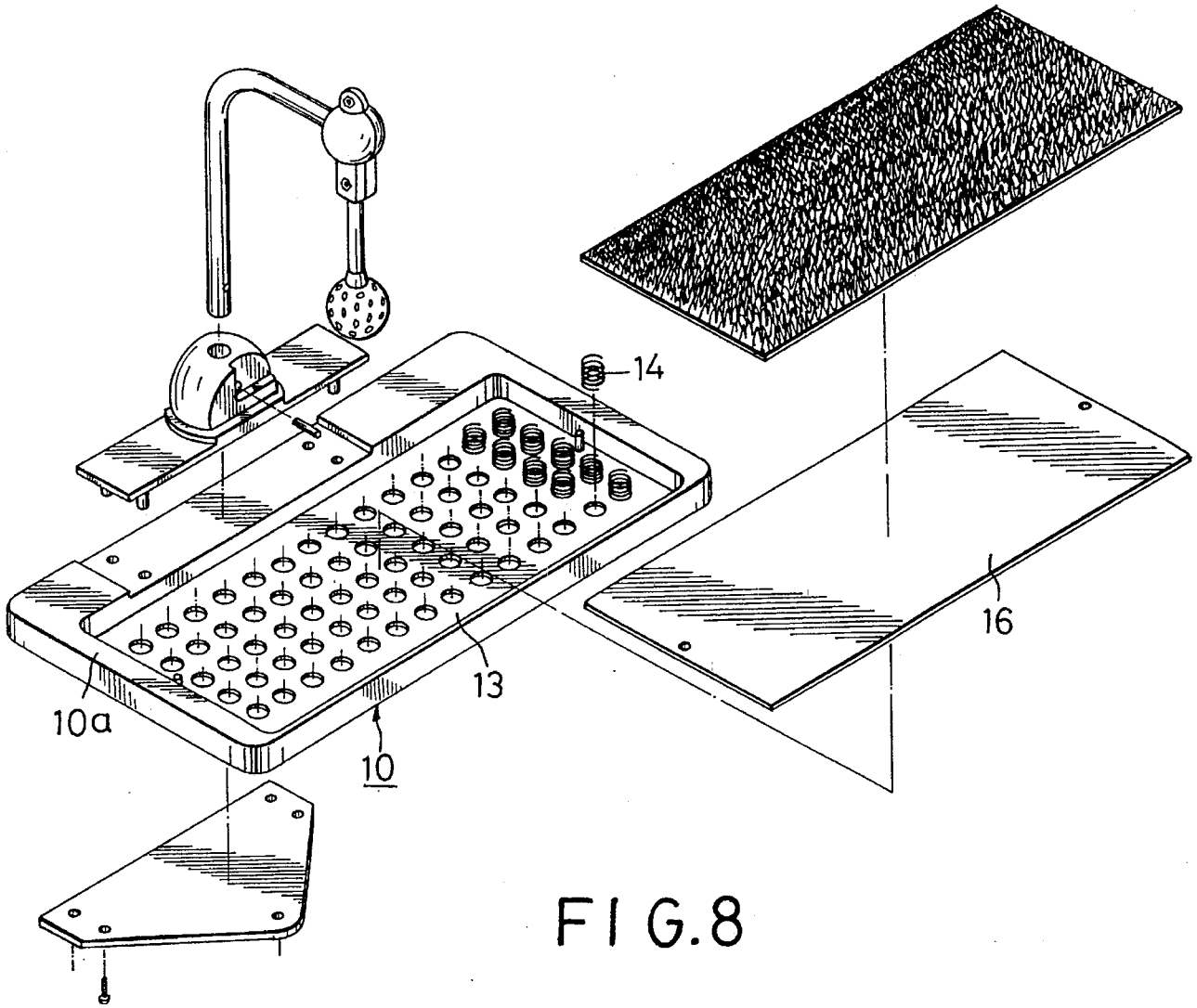
FIG. 8 is a partially exploded view of a second preferred embodiment of this invention.

Referring to FIG. 8, a second preferred embodiment is shown to be generally similar to the first preferred embodiment in construction except that the base unit 10 includes a rectangular support plate 10*a* with a rectangular recess 13 formed in an upper surface thereof, a plurality of spaced springs 14 confined in the recess 13, and a cover sheet 16 attached to the support plate 10*a* and disposed on the spring units 14 in such a manner that the cover sheet 16 is biased to move upward so that the cover sheet 16 is generally flush with the top surface of the support plate 10*a*.

In that event that a golf club head (not shown) hits the cover sheet 16 instead of the golf ball during a striking action by the user, the cover sheet 16 retracts resiliently into the recess 13 so as to prevent damage to the golf club head.

With this invention thus explained, it is obvious to those skilled in the art that various modifications and variations can be made without departing from the scope and spirit thereof. Therefore, the invention be limited only as in the appended claims.

I claim:

1. A golf ball tee device including a base unit, an inverted L-shaped support rod which has a vertical lower end portion fixed on said base unit and a horizontal upper end portion, and a rotatable device mounted on the upper end portion of said support rod and capable of being rotated about the upper end portion, wherein the improvement comprises:

said rotatable device including a ball body which is secured on the upper end portion of said support rod and a casing which encloses rotatably said ball body, and a ball unit which includes a golf ball and a connecting rod that interconnects securely said ball body and said golf ball in such a manner that said golf ball is located at a level above said base unit in a spaced-apart relationship;

whereby, said casing and said ball unit rotate about said ball body when said golf ball is struck.

2. The golf ball tee device as defined in claim 1, wherein said casing includes two hollow casing halves which confine said ball body therein and which have two notches respectively, said notches of said casing halves cooperatively forming a hole in said casing for extension of the upper end portion of said support rod therethrough.

3. The golf ball tee device as defined in claim 1, wherein said base unit includes a rectangular support plate with a recess formed in an upper surface thereof, a plurality of spaced springs confined in said recess, and a cover sheet attached to said support plate and disposed on said spring units in such a manner that said cover sheet is biased to move upward;

whereby, in event that a golf club head strikes said cover sheet during teeing, said cover sheet retracts resiliently into said recess so as to prevent damage to said golf club head.

* * * * *